United States Patent [19]

Migita et al.

[11] Patent Number: 4,870,457

[45] Date of Patent: Sep. 26, 1989

[54] ELECTROPHOTOGRAPHIC COPYING MACHINE WITH DEVICE FOR ELIMINATING UNWANTED BLACK AREAS

[75] Inventors: Haruyoshi Migita; Shunju Anzai, both of Nara, Japan

[73] Assignee: Sharp Kabushiki Kaisha, Osaka, Japan

[21] Appl. No.: 217,050

[22] Filed: Jul. 7, 1988

Related U.S. Application Data

[63] Continuation of Ser. No. 906,300, Sep. 11, 1986, abandoned.

[30] Foreign Application Priority Data

Oct. 11, 1985 [JP] Japan ..... 60-227369
Oct. 11, 1985 [JP] Japan ..... 60-227370

[51] Int. Cl.[4] ..... G03G 15/00; G03G 15/04

[52] U.S. Cl. ..... 355/208; 355/205; 355/228; 355/229

[58] Field of Search ..... 355/3 R, 3 CH, 14 R, 355/14 E, 3 ER, 15, 7

[56] References Cited

U.S. PATENT DOCUMENTS 4,551,008 11/1985 Banton ..... 355/14 E
4,576,464 3/1986 Sakata et al. ..... 355/14 E X
4,582,417 4/1986 Yagasaki et al. ..... 355/7
4,593,989 6/1986 Fujiwara et al. ..... 355/3 R
4,640,601 2/1987 Deguchi et al. ..... 355/14 E X

*Primary Examiner*—A. C. Prescott
*Attorney, Agent, or Firm*—Flehr, Hohbach, Test, Albritton & Herbert

[57] ABSTRACT

A copying machine includes a device for eliminating unwanted black areas caused by insufficient light exposure when copies are made, for example, from a bulky original. The device includes a central processing unit to calculate the timing at which an auxiliary light source disposed inside the copying machine should be turned on so that the portions of a latent image formed on its photosensitive body, which would result in unwanted black areas on the copy paper, are eliminated by the timely exposure of these portions by the auxiliary light source.

5 Claims, 6 Drawing Sheets

ELECTROPHOTOGRAPHIC COPYING MACHINE WITH DEVICE FOR ELIMINATING UNWANTED BLACK AREAS

This is a continuation of application Ser. No. 906,300, filed on Sept. 11, 1986, now abandoned.

BACKGROUND OF THE INVENTION

This invention relates to an exposure-controlling device for an electrophotographic copying machine and more particularly to a device in an electrophotographic copying machine for eliminating unwanted black areas at the edges of an image.

A conventional electrophotographic copying machine contains a photosensitive body which is preliminarily charged by a charger and on which an electrostatic latent image is formed by an exposure to light. A positive image is formed by means of a toner which is oppositely charged and is transferred to a copy paper. The transferred image is fixed by heating and this is how the copying process is effected. With a conventional copying machine of this type, the light-exposure process is effected by moving either the original document or an optical unit with respect to the other such that a lamp which forms a part of the optical system scans the document. During this process, the document is usually covered by what may be referred to as a document cover but if the document to be copied is very thick or bulky such as a bound book, the document cover may float above the table on which the document is placed. This has the effect of reducing the quantity of light reflected by the document cover and hence of forming an undesirable electrostatic latent image on the photosensitive body, this in turn causing black areas to appear on the copy paper. This common phenomenon is illustrated in FIG. 7 which shows unwanted black areas 9c at the front and back edges of a copy in the direction of scan. These black areas 9c come about because, when a bulky document such as a bound book is placed on the document table, the distance along which the book contacts the document table becomes smaller than the actual size of the book. Black areas 9b also appear as shown where the amount of reflected light is reduced. Such unwanted black areas also appear if the original document is moved when the document cover is closed after the document is correctly positioned on the document table.

SUMMARY OF THE INVENTION

In view of the appearance of unwanted black areas as explained above, a method has been developed as disclosed in Japanese Patent Application No. 59-144049 (Publication Tokkai No. 61-20963 on Jan. 29, 1986) for eliminating such areas by providing an auxiliary lamp between a charger and a developing station to eliminate the electrostatic latent image which causes the black areas and specifying a range from outside.

It is an object of the present invention to provide a device in an electrophotographic copying machine for eliminating unwanted black areas especially when a thick original, such as a page from a book, is copied by using the basic principle disclosed in the aforementioned patent publication but without the need to specify any range of unwanted black areas to be eliminated.

The above and other objects of the present invention are achieved by providing a copying machine having an auxiliary lamp as disclosed in the aforementioned Japanese patent publication with a means to calculate the timing at which this auxiliary light comes to confront the edge sections of a latent image on its photosensitive body and a means to operate the lamp according to this calculated timing such that the portions of the image which would result in unwanted black areas on the copy can be eliminated. In one aspect of the present invention, the auxiliary lamp is operated only when a detector indicates that the document cover, which would close on the document table if the original document to be copied is an ordinary sheet of paper, is not in the closed condition. According to another aspect of the invention, consideration is given to the situation where a book is opened on the document table and two pages on both sides of it are copied on two sheets of copy paper. A special input key is provided such that if the user selects this mode of copying by operating this key, the auxiliary lamp is turned on and off selectively as it scans the latent image on the photosensitive body to eliminate the unwanted black areas.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 7B:
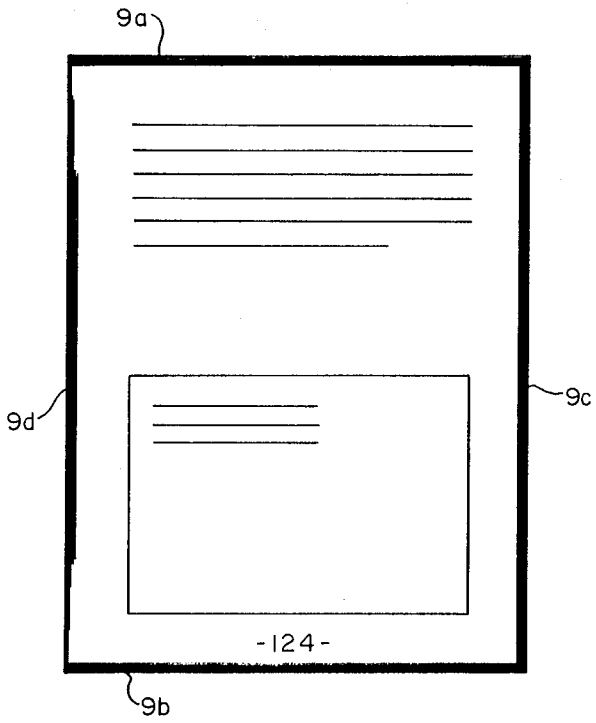
FIGS. 7A and 7B are a plan view of illustrative copies obtained by a conventional copying machine.
Figure 7A:
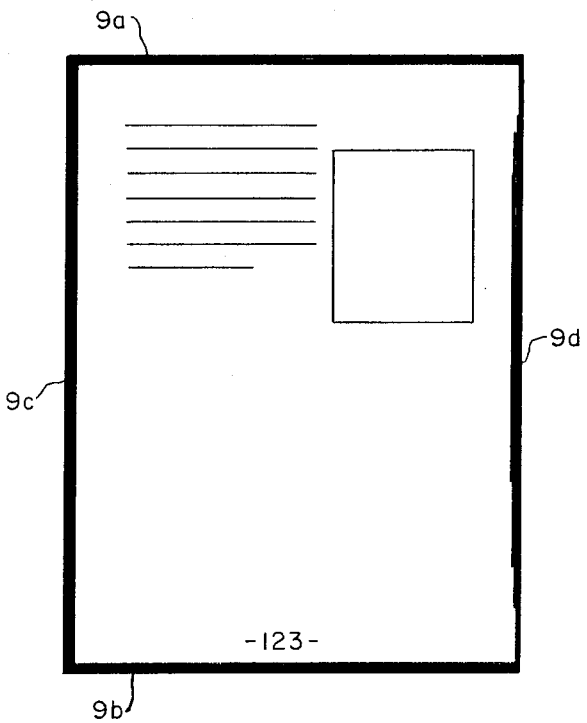

In what follows, the present invention will be described by way of an electrophotographic copying machine which can eliminate unwanted black areas not only of the types 9c and 9d shown in FIG. 7 but also of the types 9a and 9b. These unwanted black areas at the edges occur if the original document to be copied is not placed exactly at the designated position or if the book to be copied is somewhat smaller than a standard size.

(a) Structure

Figure 1:
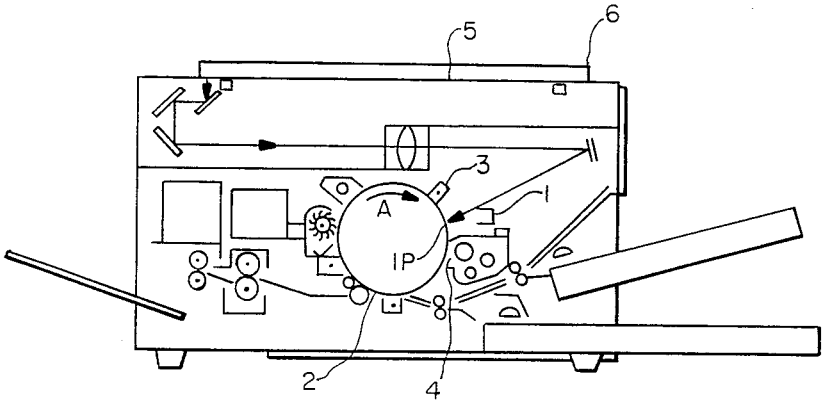
FIG. 1 is a schematic view showing the structure of a copying machine incorporating the present invention.

With reference to FIG. 1 which is a schematic view showing the structure of a copying machine incorporating the present invention, an original document to be copied is set on a document table 5 and is covered from above by a document cover 6. The photosensitive body is of a cylindrical form and is represented by the surface of a drum 2 adapted to rotate in the direction of arrow A in correspondence with the scanning by an optical system. A charger 3 is disposed above and to the right of the drum 2 and is adapted to charge the photosensitive drum 2 by a corona discharge. An image of the document is formed at an image point (IP) on the drum 2 by an optical system and a positive image is formed therefrom at a developing station 4 provided at the right-hand side of the drum 2. Between the image point IP and the developing station 4 is an auxiliary lamp, or a charge removing lamp 1 comprising an array of LEDs. The charge removing lamp 1 serves to expose to light the edge and side sections of the image formed on the photosensitive drum 2 to erase electrostatic images there.

(b) Positional Relationship Between the Charge Removing Lamp and the Image Point If the charge removing lamp 1 is disposed behind the image point as shown in FIG. 1, the charge removing lamp 1 is activated after an image of the document is formed on the photosensitive drum when the unwanted black areas at the edge and side sections of this image reach the charge removing lamp 1. If the charge removing lamp 1 is disposed in front of the image point IP, on the other hand, the charge removing lamp 1 is activated when the part of the photosensitive drum where an image of the document is going to be formed reaches the position confronting the charge removing lamp 1.

(c) Detection of a Bulky Document

Figure 2:
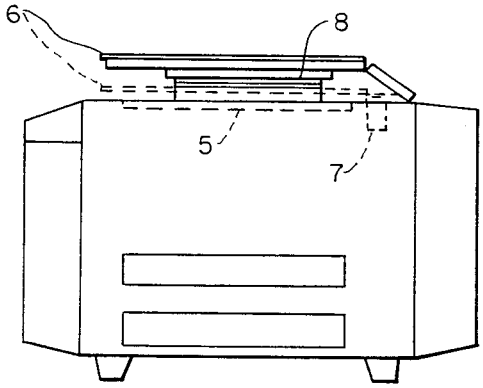
FIG. 2 is a side view of the copying machine of FIG. 1.

In FIG. 2 which is a side view of the copying machine described by way of FIG. 1, there is shown near the opening part of the document cover 6 a detector 7 for detecting whether the document cover 6 is open or closed. When a bulky document 8 such as a book is set as shown in FIG. 2, the document cover 6 floats above the document table 5, thereby setting the detector 7 in OFF condition. If the original document to be copied is a regular sheet of paper, on the other hand, the document cover 6 is completely closed as indicated by dotted lines and the detector 7 is set in ON condition.

When pages of a book are copied, copying is frequently effected in what is hereinafter referred to as the DPCM mode, or the double page copying mode, wherein two pages on both sides of the book which is opened are copied on two separate sheets of copy paper. This mode is usually used when there is no figure spanning the two pages and hence it is particularly desirable to eliminate the black area which tends to occur along the line of binding.

(d) Operation of the Charge-Removing Lamp

Figure 3:
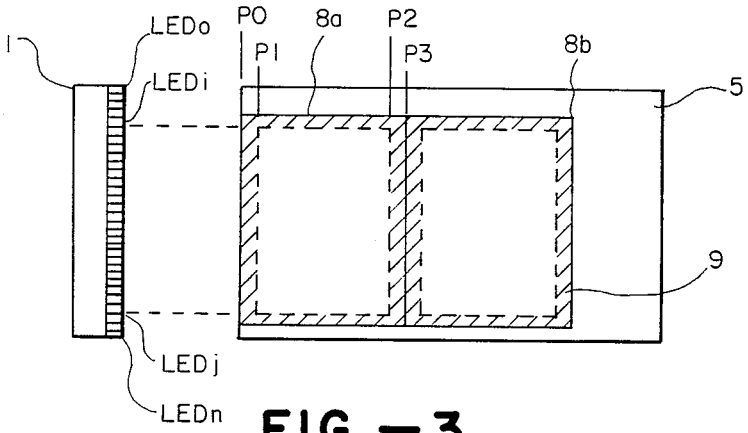
FIG. 3 is a schematic view showing the positional relationship between unwanted black areas and a document on the document table as well as the charge removing auxiliary lamp.

Regions from which unwanted black areas are to be eliminated and a method of eliminating such areas according to the present invention are illustrated in FIG. 3 for a situation wherein an open book is placed on the document table 5 with two pages 8*a* and 8*b* ready to be exposed. In such a situation, unwanted black areas are likely to appear along the binding line at the center and the edges as shown by diagonal lines in FIG. 3 or, for example, a rectangular frame with widths about 5 mm and a central line with widths about 10 mm.

The charge removing lamp 1, as shown in FIG. 3, comprises an array of LEDs ($LED_0$, $LED_2$, . . . , $LED_n$). When the region between lines P0 and P1 is scanned by the lamp 1, all LEDs are lit but between the lines P1 and P2, only $LED_0$-$LED_i$ and $LED_j$-$LED_n$ are lit. Between the lines P2 and P3, all LEDs are lit again. Thus, unwanted black areas in the shaded frame-like region can be eliminated by controlling the charge removing lamp 1 according to a properly set timing schedule.

(e) Control Section

Figure 4:
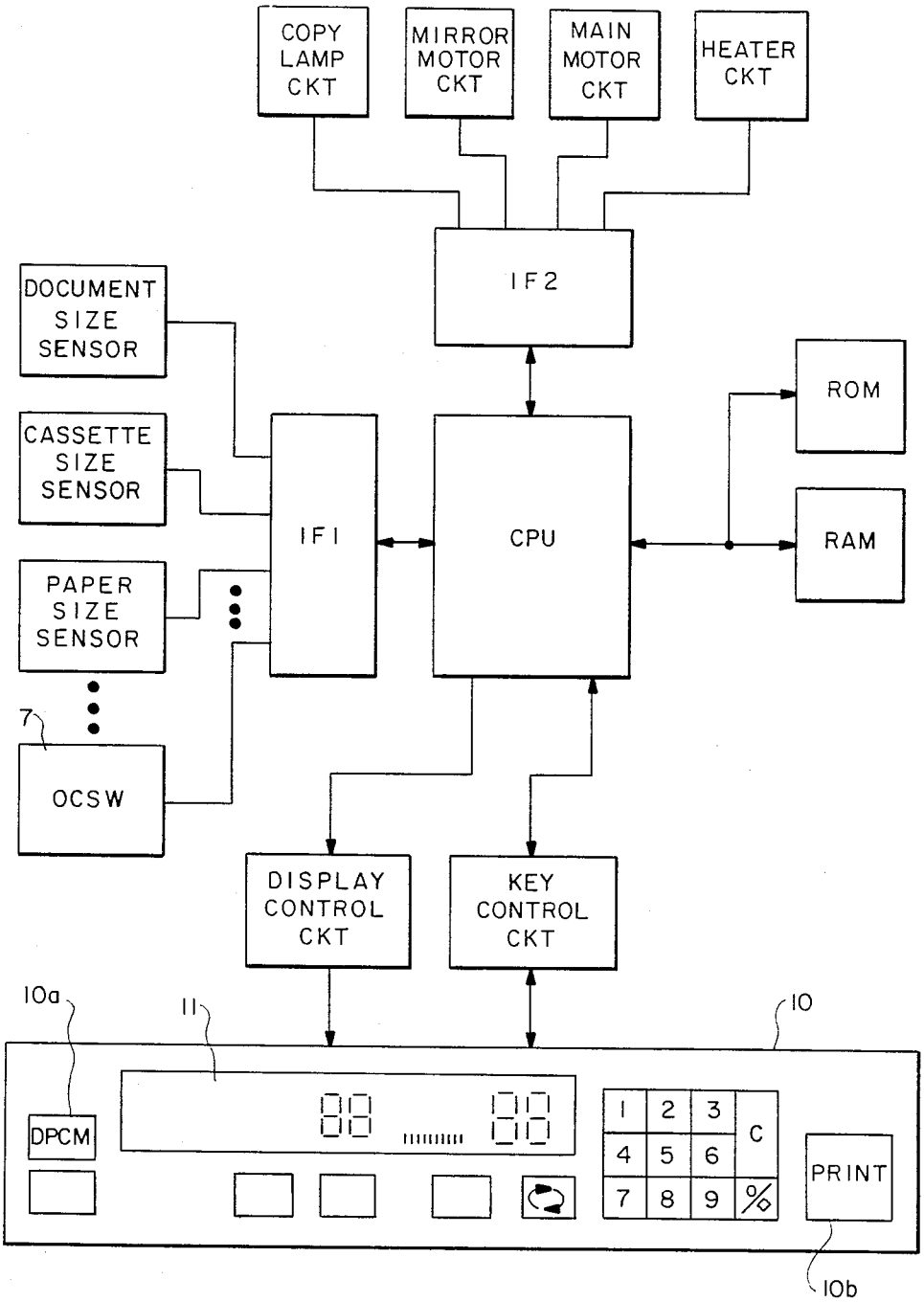
FIG. 4 is a block diagram of the copying machine.

As shown in FIG. 4, the overall operation of the copying machine is controlled by a central processing unit CPU comprising a microprocessor and its control program is preliminarily stored in a ROM means. RAM is provided to be used as a working area when the program is executed. The flags and buffers to be explained below all correspond to specified areas in this RAM. Signals from various sensors such as a document size sensor, a cassette size sensor, a copy paper size sensor and the aforementioned detector 7 (OCSW) for detecting the open-closed condition of the document cover are received by the CPU through a first interface circuit IF1. The CPU controls various control circuits such as a copy lamp circuit, a mirror motor circuit, a main motor circuit and a heater circuit through a second interface circuit IF2. The mirror motor circuit is for controlling the scanning by the optical system, the main motor circuit controls the rotation of the photosensitive drum and effects other controls.

The copying machine further includes an input panel 10 with various keys and a display unit 11. The key input device includes a DPCM key 10*a* for indicating that the system in the aforementioned DPCM mode and a PRINT key 10*b* for starting a copying operation.

(f) Operation Routine

Figure 5A:
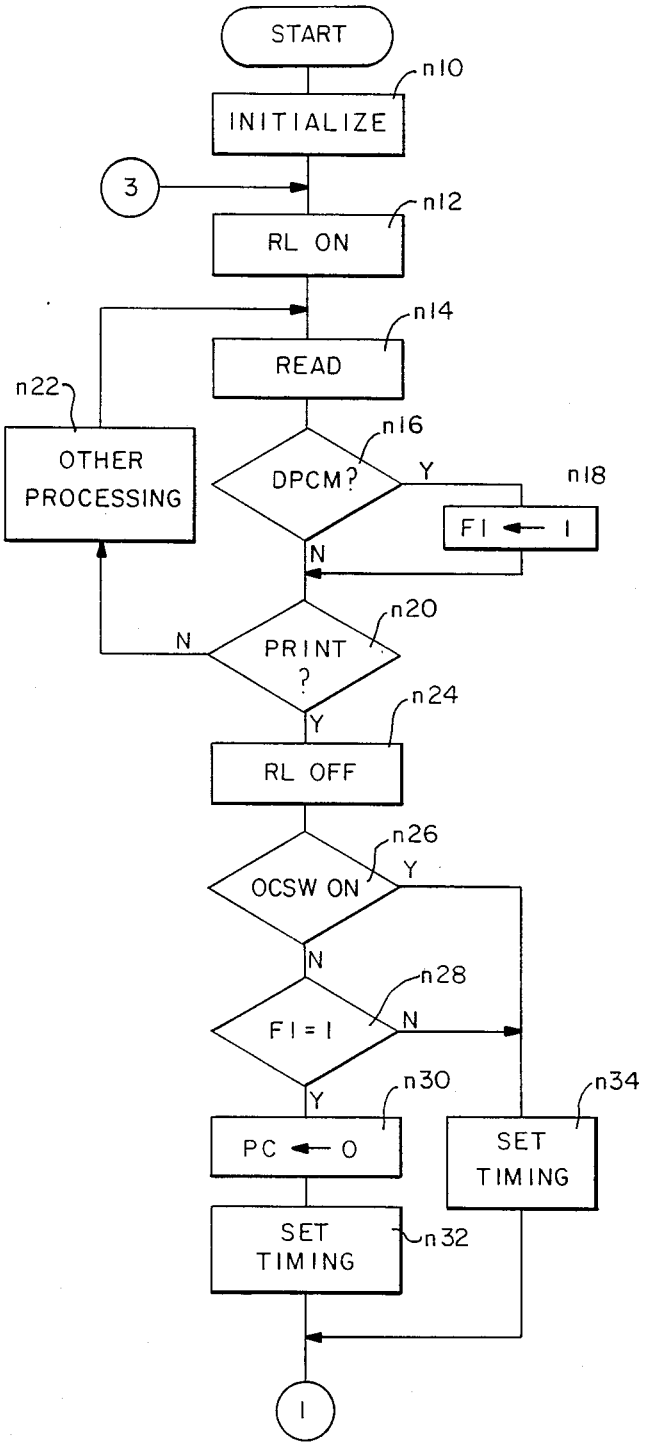
FIG. 5A, 5B and 5C are a flow chart showing the operation of the control unit of FIG. 4, FIG. 6A and 6B are a plan view of illustrative copies obtained by a copying machine embodying the present invention.
Figure 5B:
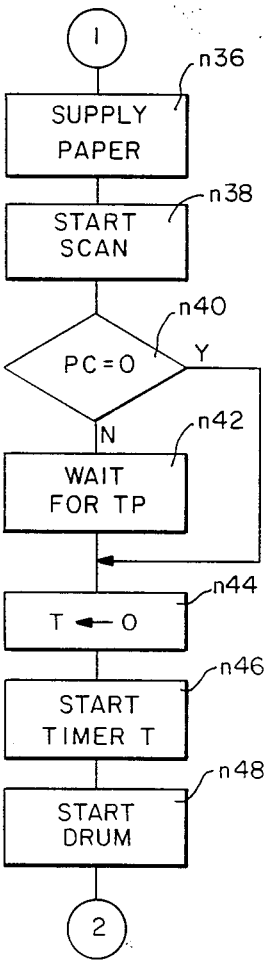
Figure 5C:
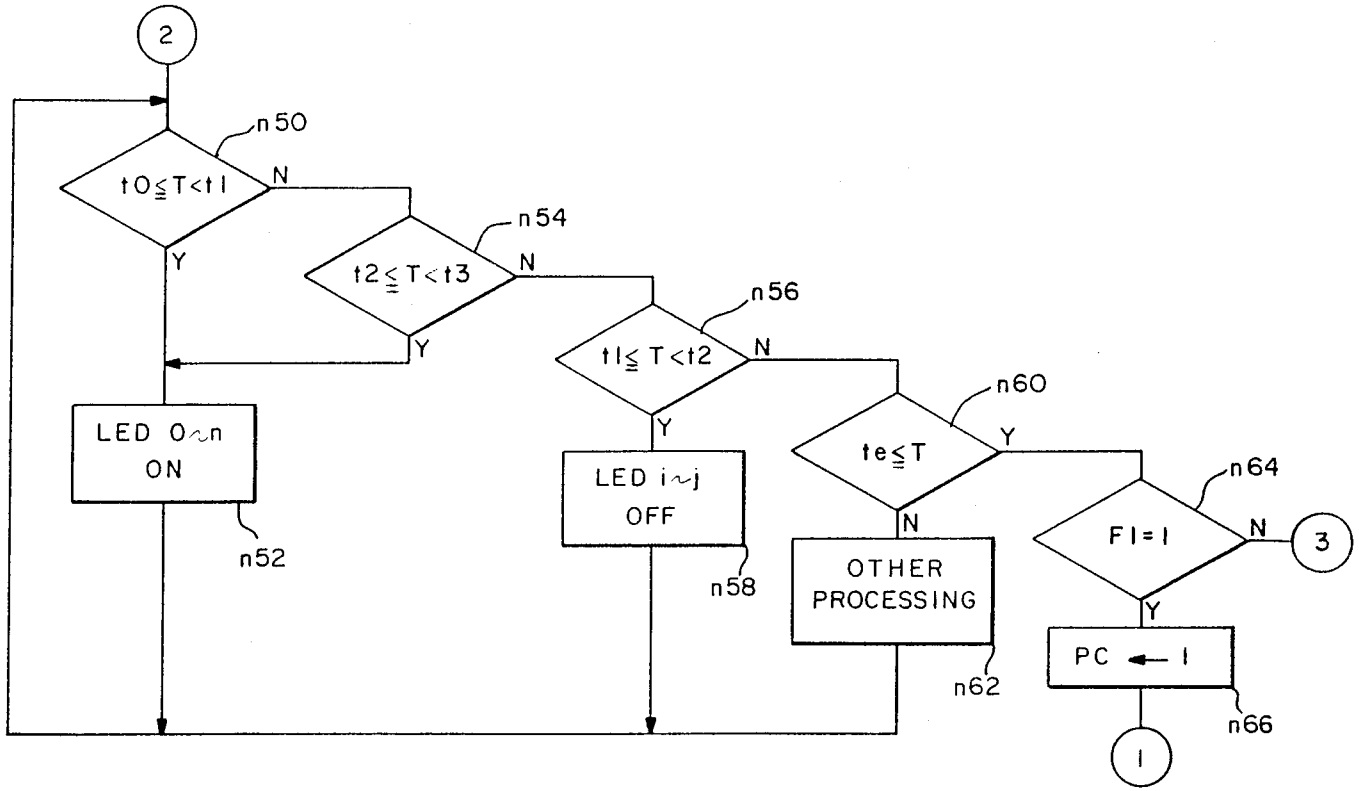

Operation of the CPU shown in FIG. 4 is explained below by way of the flow chart in FIG. 5. After power is switched on for the copying machine and initialization (n10) is completed, a ready lamp RL is lit (n12) to indicate that the copying machine is ready to operate. Thereafter, key input data are read (n14) and if the DPCM key 10*a* is pressed (n16), a flag F is set (n18) and copying is started when the PRINT key 10*b* is pressed (n20). If a different key is pressed (NO in n20), an operation corresponding to this input is performed (n22) and the program returns to Step n14.

If the PRINT key 10*b* is pressed, the ready lamp RL is turned off (n24) and the condition of the document cover detector 7 is checked (n26). If the document cover 6 is open (NO in n26) and the mode is DPCM (YES in n28), a process counter PC is reset (n30) and various timing programs inclusive of those for turning the charge removing lamp 1 on and off are set (n32). Thereafter, a copy paper is transported to a synchronization roller (or a "paper stop" roller) (n36) and the scanning by the optical system is started (n38). The timer T is then reset (n44) and started (n46) as the photosensitive drum starts to rotate (n48).

Thereafter, the timing program set in Step n32 is followed. Let us assume, for example, that the line position on the image indicated by P0 in FIG. 3 reaches the position of the charge removing lamp at time $t_0$ and that the line position P1 reaches the same position at $t_1$. Then, all LEDs of the charge removing lamp ($LED_0$-$LED_n$) are turned on (n52) when the timer reading (also denoted by T for convenience) is between $t_0$ and $t_1$ (YES in n50). Let us further assume that the line positions P2 and P3 on the image reach the position of the charge removing lamp at $t_2$ and $t_3$, respectively. Then, all LEDs are again turned on (n52) when T is between $t_2$ and $t_3$ (YES in n54). When T is between $t_1$ and $t_2$ (YES in n56), on the other hand, $LED_i$-$LED_j$ are turned off (n58). Elimination of charge around the first page 8*a* of FIG. 3 can thus be effected by this program.

Thereafter, the copy paper is forwarded and other timing processes are carried out (n62) until the timer reading reaches a preset value $t_e$ (n60). By this time, a toner image is transferred to the copy paper and is being fixed. If the flag F1 is set (or it is DPCM mode), at this moment (YES in n64), the process counter is set (n66) and the program returns to Step n36. If the flag F1 is not set (or it is not DPCM mode), the copying process is finished and the program returns to Step n12. If the program is in DPCM mode, the second page 8b of the document in FIG. 3 is subsequently copied after a waiting period of $t_p$ (n42) until the photosensitive drum begins to rotate again. In other words, the document image is formed on the photosensitive drum after the optical system reaches the line position P3 of FIG. 3. Since the second page 8b is shaped identically to the first page 8a, the same timing program can be used to process the second page 8b.

When the original document to be copied is a single sheet or when the DPCM key has not been pressed, timing $t_0$-$t_3$ is set in Step n34 such that the charge removing lamp will not be activated at all.

(g) Effects

Figure 6B:
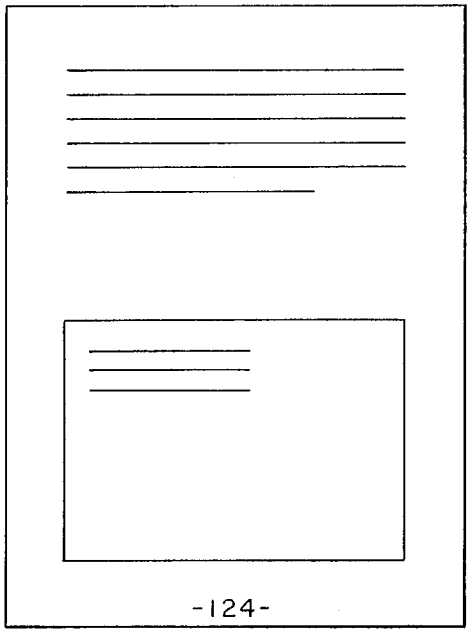
Figure 6A:
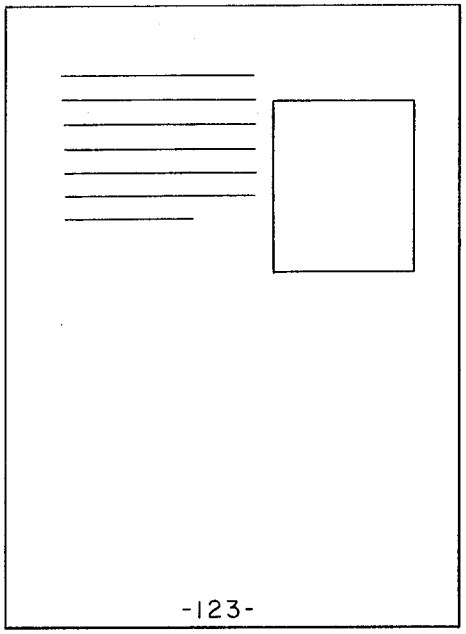

The operation described above has the effect of eliminating unwanted black areas not only at the edge sections in the direction of scan (9c and 9d) but also at the side edges (9a and 9b). Thus, even if the document is somewhat displaced from the designated document position on the document table or if the document is somewhat smaller than a standard size, copies with unwanted black areas completely eliminated can be obtained as shown in FIG. 6.

The foregoing description of a preferred embodiment of the invention has been presented for purposes of illustration and description. It is not intended to be exhaustive or to limit the invention to the precise form disclosed, and many modifications and variations are possible in light of the above teaching. For example, the present invention can be applied to a copying machine with variable magnification by controlling the charge removing lamp so as to turn on those of its LEDs confronting the edge sections of the image formed on the photosensitive drum. Although not mentioned specifically in connection with FIG. 5, the program may be designed such that unwanted black areas are eliminated independently of the output from the detector 7 and the DPCM mode (n34 of FIG. 5) or only in DPCM mode and when the document cover is afloat. Furthermore, the present invention is applicable also to a copy machine of the type using a paper coated with a photosensitive material instead of a photosensitive drum as illustrated above such that development is effected chemically. Such modifications and variations which may be apparent to a person skilled in the are are intended to be included within the scope of this invention.

What is claimed is:

1. In a copying machine which performs copying process including light-exposure routine and developing routine and comprises a document table for placing thereon an original document to be copied, a photosensitive body for forming thereon a patent image of said original document, a developing station for carrying out said developing routine, and an auxiliary light source disposed near said developing station, the improvement wherein said copying machine further comprises a device for eliminating unwanted black areas, said device including a detector for determining whether a bulky original or a sheet-like original is placed on said document table to be copied and outputting a detection signal upon determining that a bulky original is on said document table, a control means for calculating the timing at which said auxiliary light source comes to confronting positions with respect predetermined parts of said latent image, and a driving means for operating said auxiliary light sources according to said timing calculated by said computing means, said control means being programmed to activate said driving means only upon receiving said detection signal.

2. The copying machine of claim 1 wherein said control means includes a central processing unit.

3. The copying machine of claim 1 wherein said edge sections are at front and back ends of said latent image along the direction in which said latent image is scanned by said auxiliary light source.

4. The copying machine of claim 1 wherein said auxiliary light source includes an array of light emitting means extending transversely with respect to the direction in which said latent image is scanned by said auxiliary light source.

5. The copying machine of claim 1 further comprising a cover for covering said document table, said detector including means for detecting whether said cover is open or closed.

* * * * *